US008594542B2

(12) United States Patent
Kobayashi

(10) Patent No.: US 8,594,542 B2
(45) Date of Patent: Nov. 26, 2013

(54) IMAGE CONTROL FOR DETECTING AN ADJUSTMENT PATTERN AND GENERATING AN EDGE DETECTION SIGNAL

(75) Inventor: Hidenori Kobayashi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 353 days.

(21) Appl. No.: 13/009,022

(22) Filed: Jan. 19, 2011

(65) Prior Publication Data

US 2011/0188870 A1 Aug. 4, 2011

Related U.S. Application Data

(60) Provisional application No. 61/299,472, filed on Jan. 29, 2010.

(51) Int. Cl.
*G03G 15/01* (2006.01)
*G03G 15/00* (2006.01)

(52) U.S. Cl.
USPC ..... 399/301; 399/49

(58) Field of Classification Search
USPC ..... 399/49, 301; 347/116
See application file for complete search history.

(56) References Cited

U.S. PATENT DOCUMENTS

| | | | | |
|---|---|---|---|---|
| 6,829,465 | B2 * | 12/2004 | Yamanaka et al. | 399/301 |
| 6,903,759 | B2 * | 6/2005 | Yamanaka et al. | 347/116 |
| 7,130,551 | B2 * | 10/2006 | Kobayashi | 399/49 |
| 7,453,480 | B2 * | 11/2008 | Nishikawa et al. | 347/116 |
| 7,616,909 | B2 | 11/2009 | Kato et al. | |
| 2007/0274745 | A1 * | 11/2007 | Ueda et al. | 399/301 |
| 2008/0253786 | A1 * | 10/2008 | Isobe et al. | 399/69 |

* cited by examiner

*Primary Examiner* — Sandra Brase
(74) *Attorney, Agent, or Firm* — Turocy & Watson, LLP

(57) ABSTRACT

An image control apparatus according to an embodiment includes: a traveling member which carries a toner image; a detection unit which detects an adjustment pattern formed on the traveling member; and a control unit which generates an edge detection signal obtained by binarizing a detection result from the detection unit, and generates converted data obtained by analog-digital converting the detection result from the detection unit.

11 Claims, 4 Drawing Sheets

IMAGE CONTROL FOR DETECTING AN ADJUSTMENT PATTERN AND GENERATING AN EDGE DETECTION SIGNAL

CROSS-REFERENCE TO RELATED APPLICATION

This application is based upon and claims the benefit of priority from Provisional U.S. Application 61/299,472 filed on Jan. 29, 2010, the entire contents of which are incorporated herein by reference.

FIELD

Embodiments described herein relate generally to an image forming apparatus which superimposes images of plural colors formed at plural image forming stations, and thus provides a color image.

BACKGROUND

An image forming apparatus which superimposes tone images of different colors to provide a color image needs alignment control for controlling the positional relation between the toner images of different colors and image quality maintenance control for controlling the density of each color.

For example, when the time required for alignment control and image quality maintenance control at the time of warm-up of the image forming apparatus becomes longer, there is a risk that the user's waiting time before the start of print may become longer. On the other hand, when a scanning sensor for an alignment pattern and a scanning sensor for an image quality maintenance pattern are provided in order to reduce the waiting time, there is a risk that the manufacturing cost may increase.

Thus, it is desired that an image forming apparatus should be developed in which the time required for alignment control and image quality maintenance control is reduced while restraining the manufacturing cost.

DETAILED DESCRIPTION

According to an embodiment, an image control apparatus includes: a traveling member which carries a toner image; a detection unit which detects an adjustment pattern formed on the traveling member; and a control unit which generates an edge detection signal obtained by binarizing a detection result from the detection unit, and generates converted data obtained by analog-digital converting the detection result from the detection unit.

Figure 1:
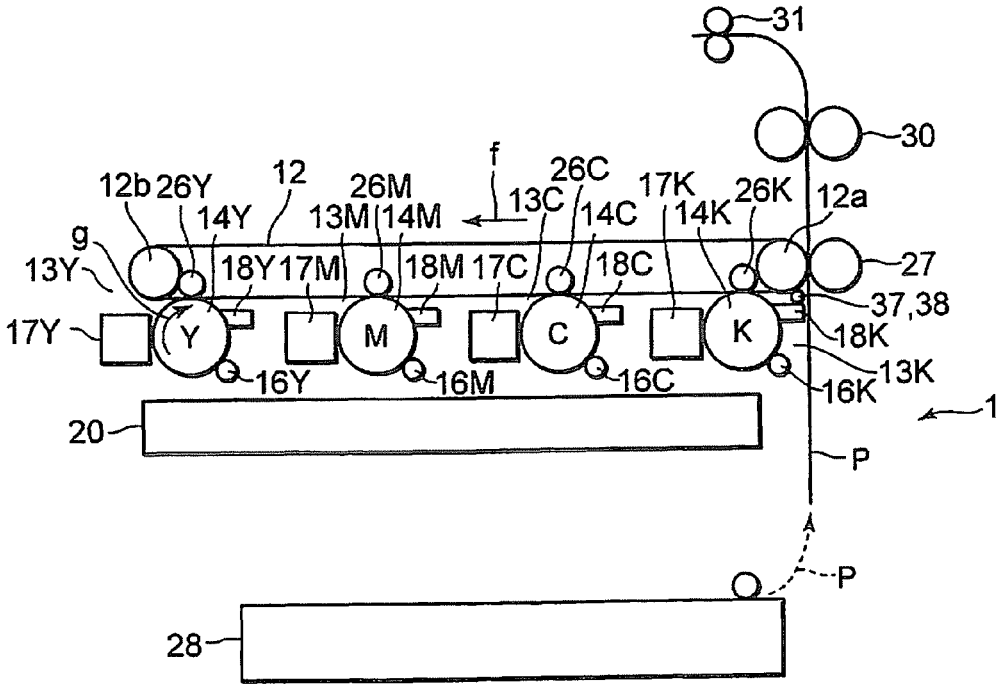
FIG. 1 is a schematic view of configuration showing essential parts of a color printer according to an embodiment.

Hereinafter, an embodiment will be described. FIG. 1 shows essential parts of a color printer 1 which is an image forming apparatus according to an embodiment. The color printer 1 includes four image forming stations 13Y, 13M, 13C and 13K as image forming units arranged in parallel along the lower side of an intermediate transfer belt 12 as a traveling member. The image forming stations 13Y, 13M, 13C and 13K include photoconductive drums 14Y, 14M, 14C and 14K, respectively. The rotation axes of the photoconductive drums 14Y, 14M, 14C and 14K are parallel to a direction (main scanning direction) orthogonal to a traveling direction (sub scanning direction) of the intermediate transfer belt 12 which is in the direction of arrow f. The rotation axes of the photoconductive drums 14Y, 14M, 14C and 14K are arranged at equal spacing along the sub scanning direction of the intermediate transfer belt 12.

The image forming stations 13Y, 13M, 13C and 13K form toner images of yellow (Y), magenta (M), cyan (C) and black (K) on the photoconductive drums 14Y, 14M, 14C and 14K, respectively.

The image forming stations 13Y, 13M, 13C and 13K include chargers 16Y, 16M, 16C and 16K, developing devices 17Y, 17M, 17C and 17K, and photoconductor cleaner 18Y, 18M, 18C and 18K, around the photoconductive drums 14Y, 14M, 14C and 14K, respectively.

The color printer 1 includes a laser exposure device 20. The laser exposure device 20 casts exposure light corresponding to each color in the areas between the chargers 16Y, 16M, 16C and 16K and the developing devices 17Y, 17M, 17C and 17K around the photoconductive drums 14Y, 14M, 14C and 14K. The laser exposure device 20 forms an electrostatic latent image based on data of each color component of image data, on the photoconductive drums 14Y, 14M, 14C and 14K. The developing devices 17Y, 17M, 17C and 17K form toner images of yellow (Y), magenta (M), cyan (C) and black (K) on the respective photoconductive drums 14Y, 14M, 14C and 14K.

The color printer 1 includes a backup roller 12*a* and a driven roller 12*b* on which the intermediate transfer belt 12 is stretched, and thus causes the intermediate transfer belt 12 to travel in the direction of arrow f. The color printer 1 includes primary transfer rollers 26Y, 26M, 26C and 26K at positions facing the photoconductive drums 14Y, 14M, 14C and 14K via the intermediate transfer belt 12. The primary transfer rollers 26Y, 26M, 26C and 26K perform primary transfer by superimposing the toner images on the photoconductive drums 14Y, 14M, 14C and 14K, onto the intermediate transfer belt 12. The photoconductor cleaner 18Y, 18M, 18C and 18K remove and collect the remaining toner on the photoconductive drums 14Y, 14M, 14C and 14K after primary transfer.

The color printer 1 includes a secondary transfer roller 27 at a secondary transfer position facing the backup roller 12*a* via the intermediate transfer belt 12. The color printer 1 performs one-shot secondary transfer of the toner images on the intermediate transfer belt 12 to a sheet P supplied from a paper supply unit 28, in a nip between the intermediate transfer belt 12 and the secondary transfer roller 27.

The color printer 1 includes a fixing device 30 and a paper discharge roller 31 along the carrying direction of the sheet P and downstream from the secondary transfer roller 27. In the color printer 1, the fixing device 30 fixes the toner image to the sheet P and the paper discharge roller 31 discharges the sheet P.

The color printer 1 includes, as a detection unit, a front sensor 37 on the front side and a rear sensor 38 on the rear side, downstream from the black (K) image forming station 13K around the intermediate transfer belt 12. The front sensor 37 detects a front adjustment pattern formed in a front area parallel to the traveling direction of the intermediate transfer belt 12. The rear sensor 38 detects a rear adjustment pattern formed in a rear area parallel to the traveling direction of the intermediate transfer belt 12. The color printer 1 performs alignment of the toner image and image quality maintenance, based on the results of detection from the front sensor 37 and the rear sensor 38.

Figure 2:
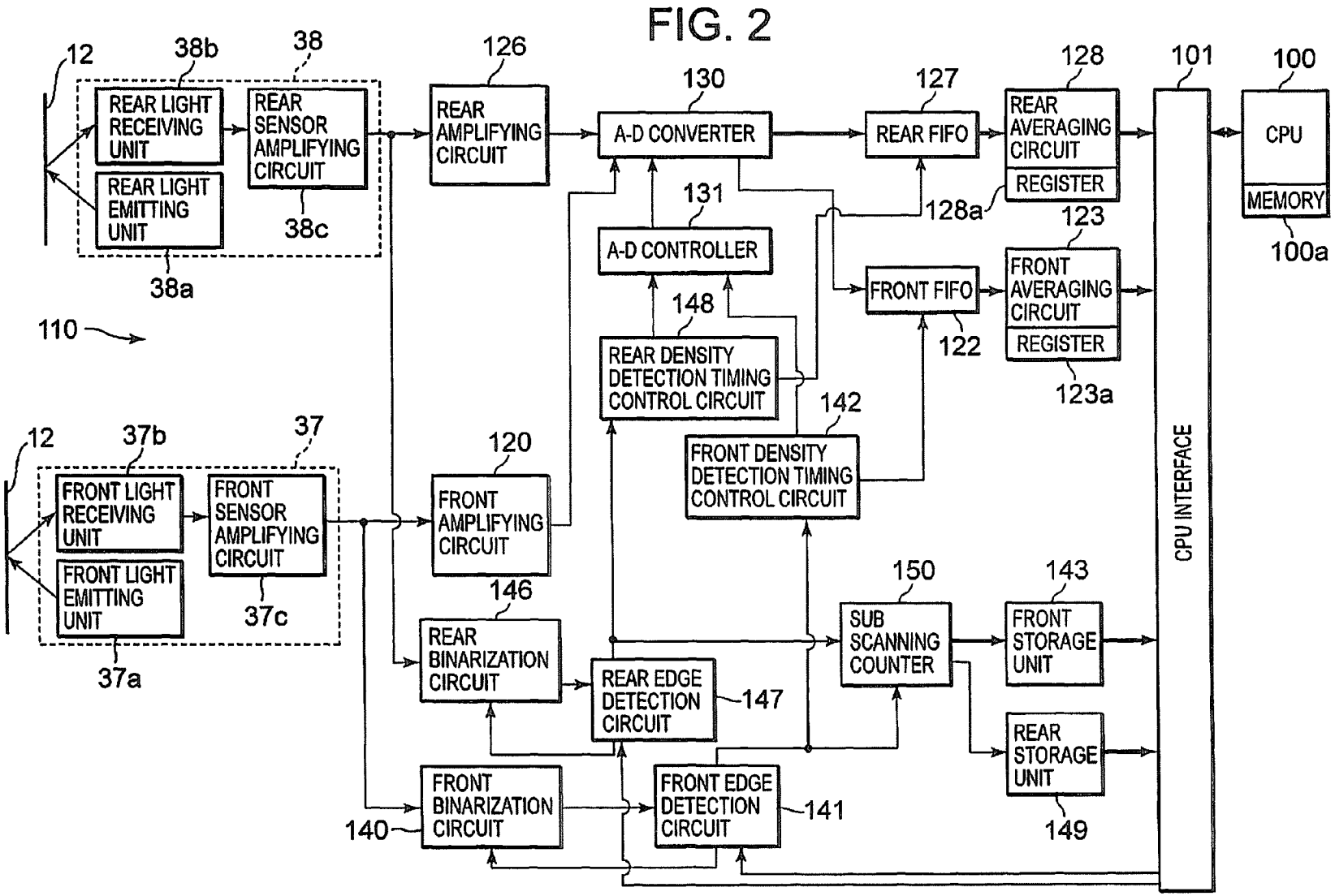
FIG. 2 is a schematic block diagram showing a processing circuit of detection data from a front sensor and a rear sensor according to the embodiment.

A data processing circuit 110 shown in FIG. 2 performs analog processing and digital processing to the results of detection from the front sensor 37 and the rear sensor 38. The front sensor 37 includes a front light emitting unit 37*a*, a front light receiving unit 37*b*, and a front sensor amplifying circuit 37*c*. The rear sensor 38 includes a rear light emitting unit 38*a*, a rear light receiving unit 38*b*, and a rear sensor amplifying circuit 38*c*.

Adjustment patterns of yellow (Y), magenta (M), cyan (C) and black (K) may have different reflection characteristics depending on the color. When reflected light from adjustment patterns having different reflection characteristics is received, the light receiving characteristics of the sensor differ depending on the color. For example, the reflection characteristic from the black (K) adjustment pattern is different from the reflection characteristics from the other adjustment patterns than the black (K) adjustment pattern, that is, the yellow (Y), magenta (M) and cyan (C) adjustment patterns.

When the reflection characteristic from the black (K) adjustment pattern differs from the reflection characteristics from the other adjustment patterns than the black (K) adjustment pattern, the detection characteristics of the sensor are changed between when the black (K) adjustment pattern is detected and when the other adjustment patterns than the black (K) adjustment pattern are detected. To change the detection characteristics of the sensor, for example, the amplification factor of the amplifying circuit of the sensor is changed or the output from the light emitting unit is changed. Moreover, to change the detection characteristics of the sensor, for example, a sensor which includes two light emitting units and uses the different light emitting units may be provided.

A CPU 100 which controls the entire color printer 1 connects to the data processing circuit 110 via a CPU interface 101. The data processing circuit 110 includes a front amplifying circuit 120 which performs analog processing of data detected by the front sensor 37, an analog-digital (A-D) converter 130, a front FIFO 122 which stores the result of conversion by the A-D converter 130, and a front averaging circuit 123. The front averaging circuit 123 includes a register 123*a* which stores a calculated average density value. The data processing circuit 110 includes a rear amplifying circuit 126 which performs analog processing of data detected by the front sensor 38, a rear FIFO 127 which stores the result of conversion by the A-D converter 130, and a rear averaging circuit 128. The rear averaging circuit 128 includes a register 128*a* which stores a calculated average density value.

The data processing circuit 110 includes an analog-digital (A-D) controller 131 which manages time-sharing of the A-D converter 130. As the A-D controller 131 manages time-sharing of the A-D converter 130, the front sensor 37 and the rear sensor 38 share the A-D converter 130.

The data processing circuit 110 includes a front binarization circuit 140 which performs digital processing of data detected by the front sensor 37, a front edge detection circuit 141, a front density detection timing control circuit 142, and a front storage unit 143 which stores a count value at the time of edge detection. The data processing circuit 110 includes a rear binarization circuit 146 which performs digital processing of data detected by the rear sensor 38, a rear edge detection circuit 147, a rear density detection timing control circuit 148, and a rear storage unit 149 which stores a count value at the time of edge detection. The data processing circuit 110 includes a sub scanning counter 150 which commonly manages the data processing by the front sensor 37 and the detection timing of the rear sensor 38.

Figure 3:
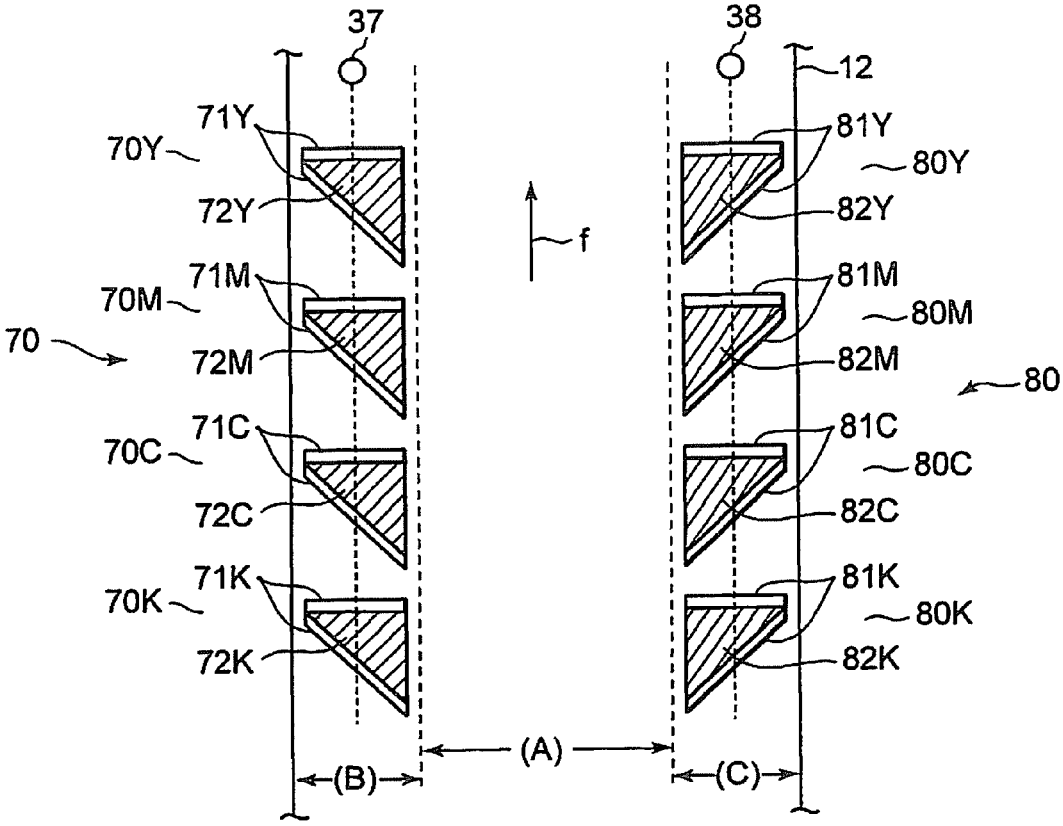
FIG. 3 is a schematic explanatory view showing an adjustment pattern on an intermediate transfer belt according to the embodiment.

The intermediate transfer belt 12 includes a front area (B) parallel to the traveling direction of the intermediate transfer belt 12 in the direction of arrow f, to the front side of an image forming area (A), and a rear area (C) parallel to the traveling direction of the intermediate transfer belt 12 in the direction of arrow f, to the rear side of the image forming area (A), as shown in FIG. 3. The front area (B) and the rear area (C) are, for example, non-image forming areas. At the time of alignment and image quality maintenance control, the color printer 1 prints an adjustment pattern on the intermediate transfer belt 12. The image forming stations 13Y, 13M, 13C and 13K print front adjustment patterns 70 in the front non-image forming area (B) and rear adjustment patterns 80 in the rear non-image forming area (C). The front adjustment patterns 70 include front adjustment patterns 70Y, 70M, 70C and 70K of the four colors of yellow (Y), magenta (M), cyan (C) and black (K). The rear adjustment patterns 80 include rear adjustment patterns 80Y, 80M, 80C and 80K of the four colors of Y, M, C and K.

The front adjustment patterns 70Y, 70M, 70C and 70K of the four colors have preset spacing between each other. The front adjustment patterns 70Y, 70M, 70C and 70K of the four colors include, for example, wedged front edge patterns 71Y, 71M, 71C and 71K with the density of 100%, respectively. The front adjustment patterns 70Y, 70M, 70C and 70K of the four colors include half-tone front patch patterns 72Y, 72M, 72C and 72K which contact the front edge patterns 71Y, 71M, 71C and 71K and have a lower density than the front edge patterns 71Y, 71M, 71C and 71K, respectively.

The rear adjustment patterns 80Y, 80M, 80C and 80K of the four colors have preset spacing between each other and include wedged rear edge patterns 81Y, 81M, 81C and 81K with the density of 100%, similarly to the front adjustment patterns 70Y, 70M, 70C and 70K. The rear adjustment patterns 80Y, 80M, 80C and 80K of the four colors include half-tone rear patch patterns 82Y, 82M, 82C and 82K which contact the rear edge patterns 81Y, 81M, 81C and 81K and have a lower density than the rear edge patterns 81Y, 81M, 81C and 81K, respectively. The shape of the front adjustment patterns 70Y, 70M, 70C and 70K and the rear adjustment patterns 80Y, 80M, 80C and 80K is not limited.

Figure 4:
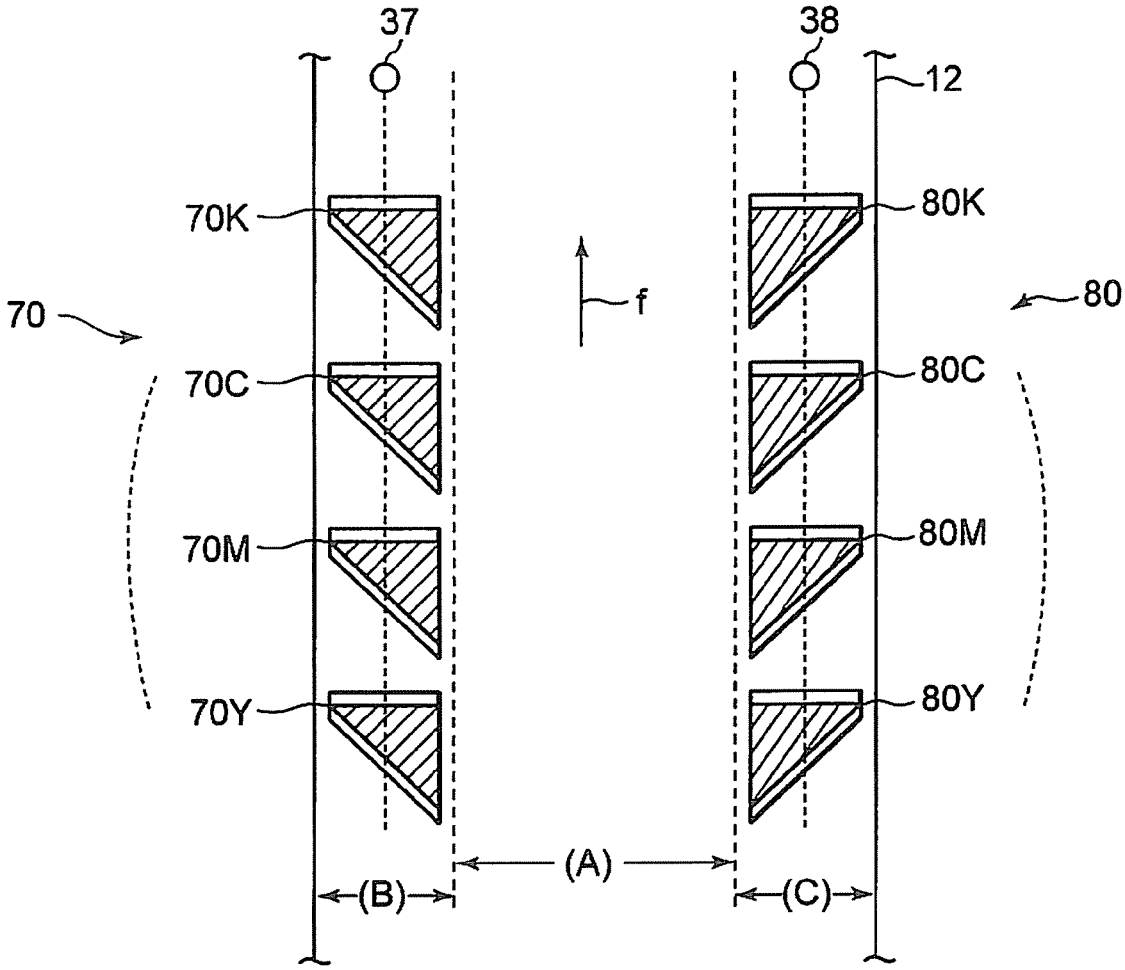
FIG. 4 is a schematic explanatory view showing another example of the arrangement of the adjustment pattern on the intermediate transfer belt.

The arrangement of the front adjustment patterns 70Y, 70M, 700 and 70K and the rear adjustment patterns 80Y, 80M, 80C and 80K of the four colors on intermediate transfer belt 12 is not limited. For example, as shown in another example of arrangement of FIG. 4, the front adjustment patterns are arranged in order of 70K, 70C, 70M and 70Y and the rear adjustment patterns in order of 80K, 80C, 80M and 80Y on the intermediate transfer belt 12 in accordance with the arrangement of the image forming stations 13Y, 13M, 13C and 13K. With the arrangement of FIG. 4, the color printer 1 prints the adjustment patterns of the four colors on the intermediate transfer belt 12 efficiently in a short time.

For the arrangement of the adjustment patterns of the four colors, for example, the other adjustment patterns than the black (K) adjustment pattern are arranged in a group on the intermediate transfer belt 12. For example, when the black (K) adjustment pattern and the other adjustment patterns than the black (K) adjustment pattern have different reflection characteristics and the detection characteristics of the sensor are changed between the black (K) and the other colors than black (K), the number of times of change can be reduced.

The color printer 1 controls alignment of toner images and main quality maintenance, for example, at the time of warm-up or restoration from sleep mode. At the time of control, the color printer 1 prints the front adjustment patterns 70 in the front non-image forming area (B) on the intermediate transfer belt 12 and prints the rear adjustment patterns 80 in the rear non-image forming area (C).

When the front sensor 37 of the data processing circuit 110 detects the front adjustment patterns 70, the front sensor 37 inputs the detected data to the front amplifying circuit 120 and the front binarization circuit 140. When the rear sensor 38 detects the rear adjustment patterns 80, the rear sensor inputs the detected data to the rear amplifying circuit 126 and the rear binarization circuit 146. The data processing circuit 110 performs analog processing of the detected data inputted to the front amplifying circuit 120 or the rear amplifying circuit 126 for image quality maintenance control. The data processing circuit 110 performs digital processing of the detected data inputted to the front binarization circuit 140 or the rear binarization circuit 146 for alignment control.

[Image Quality Maintenance Control on the Front Sensor Side]

Figure 5:
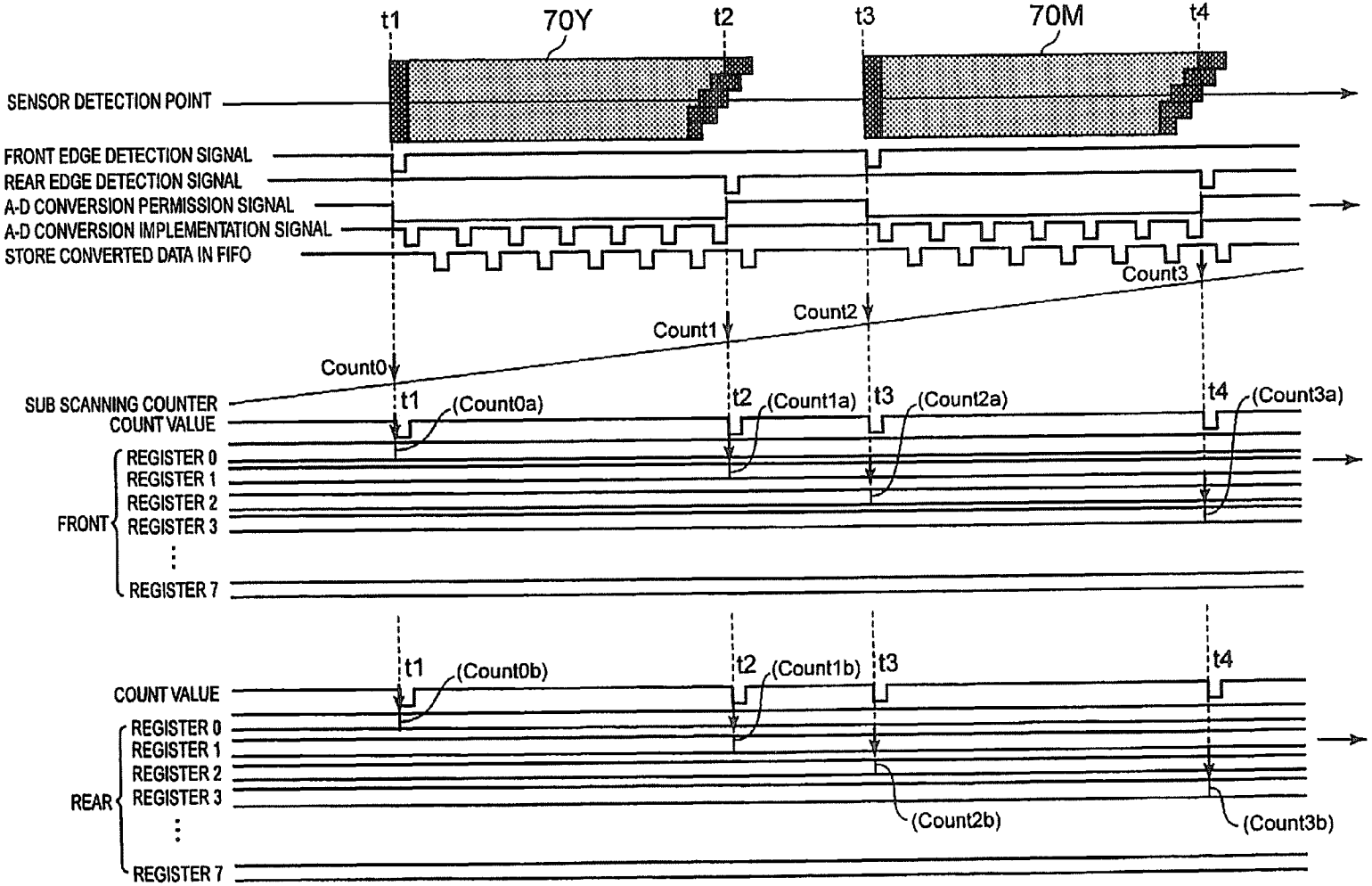
FIG. 5 is a timing chart showing a part of image density information detection and edge information detection of detection data according to the embodiment.

As shown in FIG. 5, for example, when the yellow (Y) front adjustment pattern 70Y reaches the front sensor 37, the front binarization circuit 140 of the data processing circuit 110 binarizes the detected data from the front sensor 37 and transmits the presence of the detected data to the front edge detection circuit 141. When the output level of the front sensor 37 becomes lower than a preset reference, the front binarization circuit 140 determines that the front adjustment pattern 70 is present on the intermediate transfer belt 12. When the output level of the front sensor 37 becomes equal to or higher than the preset reference, the front binarization circuit 140 determines that the front adjustment pattern 70 is absent on the intermediate transfer belt 12.

(1) When the front binarization circuit 140 determines that the front adjustment pattern 70Y is present, the front edge detection circuit 141, for example, samples the determination by the front binarization circuit 140 plural times in order to avoid the influence of external noise. When the presence of the front adjustment pattern 70Y is maintained a prescribed number of times, the front edge detection circuit 141 determines that the front adjustment pattern 70Y is present. As the front edge detection circuit 141 determines that the front adjustment pattern 70Y is present, the front edge detection circuit 141 generates a front edge detection signal (toner-present detection signal) at a time t1. The front edge detection circuit 141 outputs the toner-present detection signal to the front density detection timing control circuit 142 and the sub scanning counter 150.

(2) When the front binarization circuit 140 maintains that the front adjustment pattern 70Y is absent a prescribed number of times or more, the front edge detection circuit 141 determines that the front adjustment pattern 70Y is absent. As the front edge detection circuit 141 determines that the front adjustment pattern 70Y is absent, the front edge detection circuit 141 generates a rear edge detection signal (toner-absent detection signal) at a time t2. The front edge detection circuit 141 outputs the toner-absent detection signal to the front density detection timing control circuit 142 and the sub scanning counter 150.

The determination level of the front binarization circuit 140 to determine whether the front adjustment patterns 70 are present or absent may be changed. For example, the determination level of the front binarization circuit 140 is initially set to a relatively low level. As the determination level of the front binarization circuit 140 is set to the relatively low level, the front edge patterns 71Y, 71M, 71C and 71K of the front adjustment patterns 70 are securely detected. Erroneous detection of the front edge patterns 71Y, 71M, 71C and 71K due to noise is prevented.

After the front edge detection circuit 141 outputs the toner-present detection signal, the determination level of the front binarization circuit 140 is changed to a relatively high level. As the determination level of the front binarization circuit 140 is changed to the relatively high level, the density of the front adjustment patterns 70 is detected. After the front edge detection circuit 141 outputs the toner-absent detection signal, the determination level of the front binarization circuit 140 is changed to a relatively low level and the front edge of the next adjustment pattern is securely detected.

Normally, when no toner is on the intermediate transfer belt 12, there is a large quantity of reflected light from the intermediate transfer belt 12 and the output from the front sensor 37 is high. When there is a toner on the intermediate transfer belt 12, reflected light from the intermediate transfer belt 12 is diffused and the quantity of reflected light is decreased. The output from the front sensor 37 is reduced.

For example, when the determination level of the front binarization circuit 140 is changed to a lower level, the influence of noise at the time of detecting the toner-present state from the toner-absent state is reduced. Erroneous detection by the front binarization circuit 140 that the toner is present due to noise is prevented more securely.

When the determination level of the front binarization circuit 140 is changed to a higher level, the influence of noise at the time of detecting the toner-absent state from the toner-present state is reduced. Erroneous detection of by the front binarization circuit 140 that the toner is absent due to noise is prevented more securely.

As will be described later, while the front binarization circuit 140 determines that the toner is present, the A-D converter 130 performs analog-digital conversion of the detected data and stores the converted data sequentially in the front FIFO 122. During this toner-present state, if the adjustment pattern having a low density is erroneously detected as toner-absent, the converted data cannot be acquired. For example, when the determination level of the front binarization circuit 140 is changed and hysteresis is provided, the influence of noise occurring before the determination of the toner-absent state after the determination of the toner-present state is reduced. Erroneous detection by the front binarization circuit 140 that the toner is absent while the toner is presented due to noise is prevented more securely.

(3) In response to the input of the toner-present detection signal at the time t1, the sub scanning counter 150 resets the count value to 0 and starts the counting. In response to the input of the toner-present detection signal, the front density detection timing control circuit 142 transmits an A-D conversion permission signal to the A-D controller 131. The A-D controller 131 transmits an A-D conversion implementation signal to the A-D converter 130 and instructs the A-D converter 130 to carry out A-D conversion of the detected data from the front sensor 37. During the period from the time t1 to the time t2, in the data processing circuit 110, the A-D converter 130 sequentially performs A-D conversion of the detected data amplified by the front amplifying circuit 120, and the converted data is stored in the front FIFO 122.

(4) In the data processing circuit 110, the front averaging circuit 123 averages the converted data stored in the front FIFO 122 and calculates the average density value of the yellow (Y) front patch pattern 72Y. At the time of calculating the average density value, the front averaging circuit 123 averages the converted data of the front patch pattern 72Y, excluding the converted data of the yellow (Y) front edge pattern 71Y with the density of 100%.

For example, the period of data sampling of the front adjustment patterns 70 in the sub scanning direction in the data processing circuit 110 is set to be greater than the advancement in the sub scanning direction of the width of the front edge pattern 71Y in the sub scanning direction. If the data sampling interval in the sub scanning direction of the front sensor 37 is set to be greater than the advancement in the sub scanning direction of the width of the front edge pattern 71Y in the sub scanning direction, the front averaging circuit 123, at the time of calculating the average density value, excludes the first converted data and the last converted data stored in the FIFO 122 and thus can exclude the data of the yellow (Y) front edge pattern 71Y with the density of 100%.

The front averaging circuit 123 may be provided in the CPU 100 instead of being provided in the data processing circuit 110, thus simplifying the data processing circuit 110. The averaging circuit is provided in the CPU 100 and the average density value of the front patch pattern 72Y is calculated within the CPU 100.

When the front averaging circuit 123 calculates the average density value, the data processing circuit 110 may avoid taking the converted data of the yellow (Y) front edge pattern 71Y with the density of 100% into the front FIFO 122, instead of excluding the converted data of the yellow (Y) front edge pattern 71Y with the density of 100% taken in the front FIFO 122.

For example, in response to the input of the toner-present detection signal, during the period from the time t1 to the time t2, the front density detection timing control circuit 142 may output a timing signal to the A-D controller 131 with a delay equivalent to the time of reception of the front edge detection signal, instead of sequentially storing the converted data from the A-D converter 130 into the front FIFO 122. The data processing circuit 110 may also avoid storing the converted data of the front edge of the front edge pattern 71Y into the front FIFO 122 by delaying the timing of starting A-D conversion by the A-D converter 130.

Moreover, for example, in the data processing circuit 110, when the front averaging circuit 123 calculates the average density value, it is also possible to average only the converted data with the half-tone density level, of the front patch pattern 72Y. To average only the converted data with the half-tone density level, the data processing circuit 110 stores the density level $\alpha$ of the converted data from the A-D converter 130 of timing immediately after the yellow (Y) front adjustment pattern 70Y is detected (timing when the front edge pattern 71Y with the density of 100% is detected), for example, in a memory 100*a* of the CPU 100 at the time t1. When the front averaging circuit 123 calculates the average density value, the data processing circuit 110 excludes the converted data having a density level equal to or higher than the density level $\alpha$, of the converted data stored in the front FIFO 122, from a calculation target. The front averaging circuit 123 selects, for example, by a comparator circuit, the converted data with a density level lower than the density level $\alpha$ (the half-tone front patch pattern 72Y) stored in the front FIFO 122 and then averages the converted data to calculate the average density value.

As the selection of the converted data averaged by the front averaging circuit 123 is not controlled on the basis of timing but controlled on the basis of the density level, the period of data sampling of the front adjustment pattern 70 in the sub scanning direction in the data processing circuit 110 can be set at a desired value. For example, by reducing the beam spot of the front light emitting unit 37*a* of the front sensor 37, it is possible to reduce the sampling period. By reducing the sampling period, it is possible to further improve the accuracy of misalignment detection of the front adjustment patterns 70, which will be described later.

(5) The front averaging circuit 123 stores the calculated average density value of the front patch pattern 72Y in the register 123*a*. The CPU 100 reads out, via the CPU interface 101, the average density value in the register 123*a* as image density information necessary for image quality maintenance control. Based on the read-out image density information, the CPU 100 performs feedback control of, for example, the quantity of exposure light from the laser exposure device 20, the developing bias in the developing device 17 or the toner density in the developing device 17 and thus maintains the image quality of yellow (Y).

(6) Also the average density values of the front patch patterns 72M, 72C and 72K of the front adjustment patterns 70M, 70C and 70K of magenta (M), cyan (C) and black (K) on the intermediate transfer belt 12 are acquired similarly to the above (1) to (5) for the yellow (Y) front adjustment pattern 70Y. The CPU 100 reads out the average density values of the front patch patterns 72M, 72C and 72K in the register 123*a* as image density information necessary for image quality maintenance control. Based on the read-out image density information, the CPU 100 performs feedback control of, for example, the quantity of exposure light from the laser exposure device 20, the developing bias in the developing device 17 or the toner density in the developing device 17 and thus maintains the image quality of magenta (M), cyan (C) and black (K).

For example, when the magenta (M) front adjustment pattern 70M reaches the front sensor 37 after the detection of the yellow (Y) front adjustment pattern 70Y is finished at the time t2, the front binarization circuit 140 transmits the presence of detected data to the front edge detection circuit 141. The front edge detection circuit 141 outputs a front edge detection signal (toner-present detection signal) at a time t3. When the front adjustment pattern 70M passes the front sensor 37, the front binarization circuit 140 transmits the absence of detected data to the front edge detection circuit 141. The front edge detection circuit 141 outputs a rear edge detection signal (toner-absent detection signal) at a time t4.

In response to the input of the toner-present detection signal at the time t3, the image quality of magenta (M) is maintained in accordance with the above (3), (4) and (5), as in the case of the yellow (Y) front adjustment pattern 70Y.

On the side of the rear sensor 38, too, the above (1) to (6) are carried out to acquire image density information for image quality maintenance control, as is done on the side of the front sensor 37. If the color printer 1 has, for example, the function of correcting the density in the laser scanning direction (main scanning direction), a correction curve is selected based on the image density information from the front sensor 37 and the rear sensor 38, and image quality maintenance in the main scanning direction is controlled.

For example, if the color printer 1 does not have the function of correcting the density in the main scanning direction, image quality maintenance can be controlled based on the detection data acquired from either the front sensor 37 or the rear sensor 38. In this case, the rear sensor 38 side acquires image density information only when necessary. For example, when there is large misalignment and the front sensor 37 side cannot detect the front adjustment pattern 70, image quality maintenance is controlled based on the rear adjustment pattern 80 detected on the rear sensor 38 side.

[Alignment Control]

The CPU 100 controls alignment based on the quantity of shift in detection timing between the front edge detection signal detected by the front sensor 37 and the rear edge detection signal detected by the rear sensor 38.

[Edge Detection by the Front Sensor 37]

(7) When the yellow (Y) front adjustment pattern 70Y on the intermediate transfer belt 12 reaches the front sensor 37, the front binarization circuit 140 transmits the presence of detected data to the front edge detection circuit 141. The front edge detection circuit 141 outputs a front edge detection signal (toner-present detection signal) at the time t1. The count value (Count 0*a*) on the sub scanning counter 150 when the front edge detection circuit 141 outputs the toner-present detection signal is stored in a register 0 of the front storage unit 143.

(8) When the yellow (Y) front adjustment pattern 70Y passes the front sensor 37, the front binarization circuit 140 transmits the absence of detected data to the front edge detection circuit 141. The front edge detection circuit 141 outputs a rear edge detection signal (toner-absent detection signal) at the time t2. The count value (Count 1*a*) on the sub scanning counter 150 when the front edge detection circuit 141 outputs the toner-absent detection signal is stored in a register 1 of the front storage unit 143.

(9) When the magenta (M) front adjustment pattern 70M on the intermediate transfer belt 12 reaches the front sensor 37, the front binarization circuit 140 transmits the presence of detected data to the front edge detection circuit 141. The front edge detection circuit 141 outputs a front edge detection signal (toner-present detection signal) at the time t3. The count value (Count 2*a*) on the sub scanning counter 150 when the front edge detection circuit 141 outputs the toner-present detection signal is stored in a register 2 of the front storage unit 143.

(10) When the magenta (M) front adjustment pattern 70M passes the front sensor 37, the front binarization circuit 140 transmits the absence of detected data to the front edge detection circuit 141. The front edge detection circuit 141 outputs a rear edge detection signal (toner-absent detection signal) at the time t4. The count value (Count 3*a*) on the sub scanning counter 150 when the front edge detection circuit 141 outputs the toner-absent detection signal is stored in a register 3 of the front storage unit 143.

(11) As for the cyan (C) and black (K) front adjustment patterns 70C and 70K on the intermediate transfer belt 12, too, the counter value (Count βa) on the sub scanning counter 150 when the toner-present detection signal is outputted and the count value (Count γa) on the sub scanning counter 150 when the toner-absent detection signal is outputted are sequentially stored in each register of the front storage unit 143, as is done with the yellow (Y) and magenta (M) front adjustment patterns 70Y and 70M.

(12) After the lapse of a sufficient time for the black (K) front adjustment pattern 70K, which is the final front adjustment pattern 70 on the intermediate transfer belt 12, to pass the front sensor 37, the data processing circuit 110 stops the counting by the sub scanning counter 150.

[Edge Detection by the Rear Sensor 38]

(13) The edge detection by the rear sensor is carried out similarly to the edge detection by the front sensor 37. For example, when the yellow (Y) rear adjustment pattern 80Y on the intermediate transfer belt 12 reaches the rear sensor 38, the rear binarization circuit 146 transmits a front edge detection signal (toner-present detection signal) to the rear edge detection circuit 147 at the time t1. The count value (Count 0*b*) on the sub scanning counter 150 when the rear edge detection circuit 147 outputs the toner-present detection signal is stored in a register 0 of the rear storage unit 149.

(14) When the yellow (Y) rear adjustment pattern 80Y reaches the rear sensor 38, the rear binarization circuit 146 transmits a rear edge detection signal (toner-absent detection signal) to the rear edge detection circuit 147 at the time t2. The count value (Count 1*b*) on the sub scanning counter 150 when the rear edge detection circuit 147 outputs the toner-absent detection signal is stored in a register 1 of the rear storage unit 149.

(15) As for the magenta (M), cyan (C) and black (K) rear adjustment patterns 80M, 80C and 80K on the intermediate transfer belt 12, too, the counter values (Count 2*b*) to (Count βb) on the sub scanning counter 150 when the toner-present detection signal is outputted and the count values (Count 3*b*) to (Count γb) on the sub scanning counter 150 when the toner-absent detection signal is outputted are sequentially stored in each register of the rear storage unit 149, as is done with the yellow (Y) rear adjustment pattern 80Y.

(16) After stopping the counting by the sub scanning counter 150, the CPU 100 reads out the front edge information acquired in the above (7) to (11) from the front storage unit 143 and reads out the rear edge information acquired in the above (13) to (15) from the rear storage unit 149. Based on the read-out front edge information and rear edge information, the CPU 100 calculates the quantity of shift in detection timing between the front edge detection signal detected by the front sensor 37 and the rear edge detection signal detected by the rear sensor 38. The CPU 100 performs feedback control of the various driving devices of the color printer 1 for alignment, based on the calculated quantity of shift in detection timing. For example, the CPU 100 performs feedback control of a mirror tilt mechanism of the laser exposure device 20 and thus controls a tilt. The CPU 100 performs feedback control of the laser output timing in the laser exposure device 20 and thus controls a shift in the main scanning direction. The CPU 100 performs feedback control of the clock frequency of the laser from the laser exposure device 20 and thus controls a magnification shift.

After alignment control and image quality maintenance control are completed, the color printer 1 cleans the front adjustment patterns 70 and the rear adjustment patterns 80 on the intermediate transfer belt 12. When a print request is made, the color printer 1 starts printing an image corresponding to image information.

While printing an image, the color printer 1, for example, periodically performs detection of image density information and detection of edge information simultaneously, and performs image quality maintenance control and alignment control based on the results of detection.

According to the embodiment, the front adjustment pattern 70 and the rear adjustment pattern 80, each having the edge pattern and patch pattern, are formed on the intermediate transfer belt 12. Image quality maintenance in the color printer 1 is controlled based on image density information acquired by analog processing of detected data of the front adjustment pattern 70 from the front sensor 37 and detected data of the rear adjustment pattern 80 from the rear sensor 38. Alignment in the color printer 1 is controlled based on edge information acquired by digital processing of the detected data of the front adjustment pattern 70 and the detected data of the rear adjustment pattern 80.

According to the embodiment, the image density information and the edge information are acquired by the two sensors, that is, the front sensor 37 and the rear sensor 38, without preparing a sensor to acquire the image density information and a sensor to acquire the edge information. As the number of expensive sensors is reduced, the manufacturing cost is restrained.

According to the embodiment, the two sensors, that is, the front sensor 37 and the rear sensor 38, detect the edge patterns and the patch patterns of the front adjustment pattern 70 and the rear adjustment pattern 80 in the same timing. According to the embodiment, the data detection time for the front adjustment pattern 70 and the rear adjustment pattern 80 is reduced. As the data detection time is reduced, the time the user waits for the start of print is reduced, for example, at the time of warm-up or restoration from sleep. As the data detection time is reduced, the driving time for the color printer 1 for image quality maintenance control and alignment control in the color printer is reduced. Thus, energy is saved and the life of replacement parts of the color printer 1 is made longer.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. An image control apparatus comprising:

a traveling member which carries a toner image;

a detection unit which comprises a front sensor which detects a front adjustment pattern formed in a front area parallel to a traveling direction of the traveling member and a rear sensor which detects a rear adjustment pattern formed in a rear area parallel to the traveling direction; and a control unit which comprises a sub scanning counter which commonly manages detection timing of the front sensor and the rear sensor, and generates a front edge detection signal based on a front detection result from the front sensor, generates front converted data obtained by binarizing a detection result based on the front detection result, generates a rear edge detection signal based on a rear detection result from the rear sensor, and generates rear converted data obtained by binarizing a detection result based on the rear detection result.

2. The apparatus of claim 1, wherein the control unit comprises an analog-digital (A-D) conversion unit which analog-digital converts the detection result from the detection unit, and the A-D conversion unit is actuated when an output of the edge detection signal is detected.

3. The apparatus of claim 1, wherein the control unit comprises an analog-digital (A-D) conversion unit which analog-digital converts the detection result from the detection unit, and the A-D conversion unit sets conversion start timing using a basic clock of the edge detection signal.

4. An image control apparatus comprising:

a traveling member which carries a toner image;

a detection unit which detects an edge pattern on the traveling member having a high image density and a patch pattern in contact with the edge pattern and having a lower image density than the edge pattern; and a control unit which generates an edge detection signal obtained by binarizing a detection result from the detection unit, and generates converted data obtained by analog-digital converting the detection result from the detection unit.

5. The apparatus of claim 4, wherein the control unit comprises an averaging circuit which averages the converted data, and the averaging circuit averages converted data of the patch pattern.

6. The apparatus of claim 4, wherein the control unit comprises an averaging circuit which averages the converted data, and the averaging circuit averages converted data having a density less than an edge density, acquired from converted data of the edge pattern.

7. The apparatus of claim 6, wherein the control unit sets a sampling period of the converted data such that a start of next scanning that continues after the edge pattern is scanned falls within a width of the edge pattern in a sub scanning direction.

8. An image control method comprising:

forming an adjustment pattern which comprises an edge pattern having a high image density and a patch pattern in contact with the edge pattern and having a lower image density than the edge pattern on a traveling member;

detecting the adjustment pattern;

binarizing a detection result of the adjustment pattern;

calculating an image shift of the adjustment pattern based on an edge detection signal obtained by the binarization;

analog-digital converting the detection result of the adjustment pattern; and calculating a density of the adjustment pattern based on converted data obtained by the analog-digital conversion.

9. The method of claim 8, wherein converted data of the patch pattern is averaged at the time of calculating the density of the adjustment pattern.

10. The method of claim 8, wherein converted data having a density less than an edge density, acquired from converted data of the edge pattern, is averaged at the time of calculating the density of the adjustment pattern.

11. The method of claim 10, wherein a sampling period of the converted data is set so that a start of next scanning that continues after the edge pattern is scanned falls within a width of the edge pattern in a sub scanning direction.

* * * * *